United States Patent [19]

Dietrich

[11] Patent Number: 4,480,925

[45] Date of Patent: Nov. 6, 1984

[54] METHOD OF MIXING FLUIDS

[76] Inventor: David E. Dietrich, 8450-101 Via Sonoma, La Jolla, Calif. 92037

[21] Appl. No.: 523,648

[22] Filed: Aug. 15, 1983

Related U.S. Application Data

[63] Continuation-in-part of Ser. No. 205,147, Oct. 10, 1980, Pat. No. 4,398,827, and Ser. No. 332,949, Dec. 21, 1981, Pat. No. 4,415,275.

[51] Int. Cl.[3] ..... B01F 5/00; B01F 13/02; B01F 15/02

[52] U.S. Cl. ..... 366/107; 366/165; 366/173; 366/178; 366/341

[58] Field of Search ..... 366/11, 76, 96, 101, 366/106, 107, 150, 165, 167, 173, 174, 176–178, 341, 183, 349, 336–340; 239/404–406; 261/79 A, 79 R, 117, 124

[56] References Cited

U.S. PATENT DOCUMENTS 981,098 1/1911 McCaskell ..... 366/107 X 3,047,275 7/1962 Cox ..... 366/165 X 3,261,593 7/1966 Sharples ..... 366/165

*Primary Examiner*—Timothy F. Simone

*Attorney, Agent, or Firm*—John L. Haller

[57] ABSTRACT

A mixing method particularly for the mixing of a plurality of fluids is described. A first fluid is injected into a mixing chamber with a given angular momentum and directed at a given tangent circle. The tangent circle has a radius less than that of the mixing chamber. A second fluid is injected into the mixing chamber at a position spaced from the first fluid injection area, and with a predetermined angular momentum opposite to that of the first fluid. The second fluid is directed at a tangent circle of radius less than that of the mixing chamber. The fluid injections are arranged such that the total angular momentum injection rate is less than angular momentum injection rates of the individual injected fluids. Any number of fluids may be mixed in this way, by suitable choice of the injection direction and angular momentum of each fluid.

26 Claims, 20 Drawing Figures

METHOD OF MIXING FLUIDS

BACKGROUND OF THE INVENTION

The present application is a continuation-in-part of application Ser. No. 205,147 filed Oct. 10, 1980, now U.S. Pat. No. 4,398,827, and application Ser. No. 332,949 filed Dec. 21, 1981, now U.S. Pat. No. 4,415,275.

The present invention relates to a mixing method. More particularly, the invention relates to a method of mixing fluids such as liquids, gases and fluidized suspensions of particles, by the interaction of counter rotating flows of fluids, a method generally known as swirl mixing, the term "swirl" being used to refer to the circulating flow of fluid.

Some swirl mixing methods are shown in U.S. Pat. Nos. 981,098, 3,261,593 and 3,862,907.

The prior art methods which use opposed fluid flows employ fluid injection structures having injector openings which direct the fluids into a mixing chamber in a tangential direction, nearly ninety degrees (90°) to a radial line to the injector opening.

This tangential injection results in the fluid located towards the outer rim of the chamber to be moving rapidly, and the fluid located towards the center of the chamber to be moving more slowly, resulting in a central "dead region" and significant viscous energy dissipation (frictional losses) near the walls.

The existence of the dead region and frictional losses retards the ability of the fluids to thoroughly mix and reduces the amount of swirl energy available for mixing and/or atomization, thereby reducing the overall volume efficiency of the mixing.

Mixing chambers are frequently used as chemical reaction chambers because of the high degree of physical contact generally between the various reagents. The common form of chemical reaction is the oxidation of a fluid such as in a combustion chamber. In such a chamber the existence of a dead region and incomplete mixing results in "hot spots" which cause the formation of noxious pollutants. Further, chemical reactions against or at the outer chamber walls are also undesirable due to boundary effects.

SUMMARY OF INVENTION

The present invention provides an improved method of mixing fluids which is more efficient and which significantly reduces the formation of dead regions within the mixing chamber.

The mixing method of the present invention includes symetrically injecting a first fluid into a mixing chamber with a given angular momentum at a first predetermined tangent circle, the first tangent circle having a radius smaller than the radius of the mixing chamber, symetrically injecting a second fluid into the mixing chamber from a position spaced from the first fluid injection area, the second fluid being injected with an angular momentum opposite to that of the first fluid and at a second predetermined tangent circle having a radius smaller than the radius of the mixing chamber, intersecting the first injected fluid with the second injected fluid such that the angular momentum of the respective fluids are counterbalanced.

Mixing of the fluids occurs at the intersection of the opposed fluid swirls due to high turbulence caused by shearing forces and fluid instabilities in this region.

Counterbalanced swirl mixing is achieved when the resulting mixture of fluids has a small net angular momentum injection rate when compared to the angular momentum injection rate of any injected fluid.

An emperically confirmed approximation of the total angular injection rate, S, is:

$$S = \sum_{i=1}^{N} M_i A_i r_i P_i \sin\phi_i$$

where i=the number of the fluid injection level (plane into which fluid species number i is injected);

N=the total number of injection levels (fluid species);

$M_i$=number of injectors (essentially identical) in the $i^{th}$ injection level;

$A_i$=cross-sectional area of an $i^{th}$ level fluid injector;

$r_i$=distance between point of fluid injection and the chamber centerline;

$P_i$=pressure drop along the $i^{th}$ level fluid injector;

$\phi_i$=the angle between the centerline of the $i^{th}$ level injector and the container radial through the $i^{th}$ injector opening (as taken from a projection onto the plane of the injectors).

When S is small compared to any term in the summation, a substantial portion of the swirl energy is converted to turbulent eddies which mix the injected fluids, and very little swirl energy occurs in the exhaust mixture, in contrast to the case where S is large. Using the counterbalanced swirl mixing method of this invention, a nozzle produces an exhaust which resists dispersion and exhibits a full-cone pattern, as opposed to an exhaust which has a high angular momentum and exhibits a hollow-cone pattern.

Any number of fluids may be mixed by this method. Each fluid is introduced at a different level in the mixing chamber, and suitable adjustments of the injection axes, area and pressure can be made so as to produce a small net angular momentum of the mixed fluids. In a preferred method, each additional fluid is introduced with a swirl direction which is opposed to the net swirl of the preceding fluid mixture.

The fluid is symetrically injected into a mixing area within the mixing chamber at each level from one injector opening in the mixing chamber wall, or from a plurality of injector openings spaced around the circumference of the chamber wall at each fluid injection level. The use of multiple symmetrically spaced injection openings promotes more uniform and efficient mixing.

According to one embodiment of the invention, the different fluids may be injected into different areas of the mixing chamber separated by barriers, each barrier having a central opening or passageways. The fluid is symetrically injected into the central area, then through the opening of the barrier into the adjacent area of the mixing chamber. This ensures that there will be a relatively large angular velocity in opposite directions where two different fluids meet, due to the socalled "figure skater effect" (spin up of the fluid). This accelerates the mixing process.

It is desirable that the mixed fluids are exhausted from the mixing chamber at an opening near the chamber axis, preferably centered on the axis. The closer the exhaust opening is centered near the axis, the more fully mixed the exhaust will be. Angular momentum conservation dictates that very large swirl velocity will occur in unmixed material initially injected with swirl, if it is forced towards the chamber axis. Thus, the background pressure force will be unable to force material sufficiently near the chamber axis to pass through a small opening until the material's angular momentum has been reduced by mixing with the opposed swirl of other injected material. On the other hand, as materials are forced towards the axis, their associated large opposed swirls results in fluid dynamic instabilities and turbulence, which greatly accelerates the mixing process.

The mixing method of the present invention results in several desirable phenomena. The material swirl generally has a radial variation of angular momentum (per unit volume) such that, near the interface of separately injected fluids, the magnitude of the angular momentum decreases with increasing radius. Such a configuration is fluid dynamically unstable and vigorous growth of small-scale eddies or "turbulence" occurs. This instability is known as "centrifugal" or Taylor instability. This turbulence rapidly mixes materials injected with opposed swirls due to locally large unstable gradients occurring between opposed swirls.

A second phenomenon which results from the mixing method of the present invention is that the fluid circulation results in a high pressure region towards the outside of the chamber. This high pressure area causes a secondary flow (teacup effect) of that fluid within the chamber that has less swirl, that is angular momentum, and therefore less centrifugal acceleration. Accordingly, that portion of the fluid within the chamber which has low angular momentum and associated centrifugal acceleration is forced towards the center of the chamber. Thus, there is selective movement of the well-mixed portions of the fluids towards the center of the chamber.

Applicant's swirl mixing method substantially reduces or eliminates the centrifugal tendency of the fluids which are mixed and ejected from the chamber. Accordingly, the ejected mixture has relatively low dispersion characteristics and has a full-cone exhaust pattern. "Full cone" exhaust means that the radial profile of the ejected mixture's axial velocity component has relatively high values near the center, as opposed to the low values occurring in rapidly swirling "hollow cone" exhaust patterns that occur when the angular momentum injection rates are not counterbalanced.

Accordingly, and in view of the above it is an object of the present invention to provide a swirl mixing method which thoroughly mixes a plurality of fluids. Another object of the present invention is to provide a swirl mixing method whereby the swirl of a first reagent is counterbalanced with the swirl of a second reagent such that the net angular momentum is small. Another object of the present invention is to provide a swirl mixing method which provides an exhaust output having reduced dispersion and a full cone pattern. Another object of the present invention is to use the injected swirl energy in mixing the injected fluids.

BRIEF DESCRIPTION OF THE ACCOMPANYING DRAWINGS

The following is a brief description of the accompanying drawings.

DESCRIPTION OF THE PREFERRED EMBODIMENT

Figure 1:
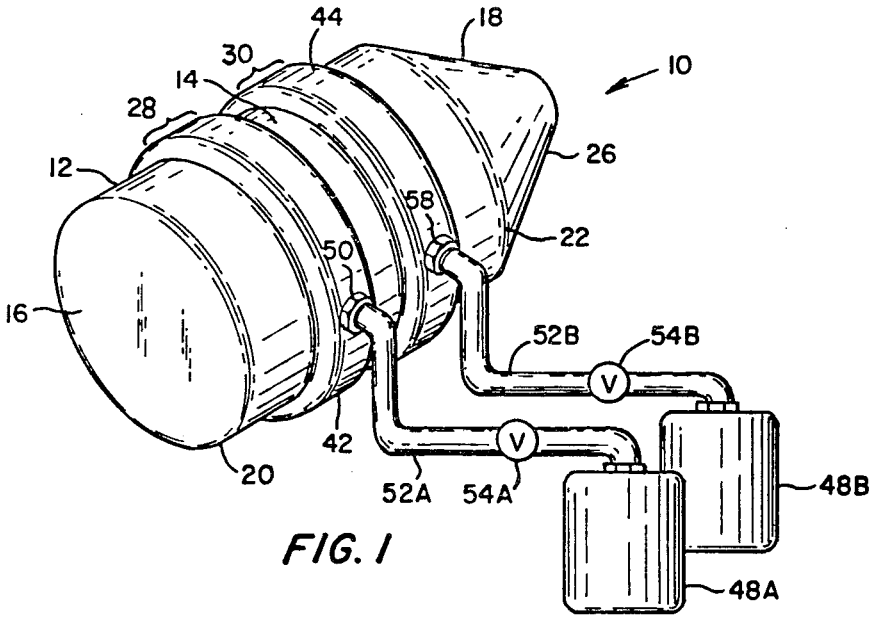
FIG. 1 is a perspective view of swirl mixing device for use in the mixing method of the present invention.

Referring to FIG. 1, there is shown a swirl mixing device 10 for carrying out the mixing method of the present invention. The device 10 comprises a cylindrically shaped container 12 having a cylindrical wall 14, a closed bottom 16 and an open upper exhaust 18. In the preferred embodiment, the cylindrical wall 14 is straight and intersects the bottom 16 with a smooth arched lower radius 20, and similarly intersects the exhaust 18 with a smooth arched upper radius 22.

The exhaust 18 is generally conically shaped, having a circular opening 24 (see FIG. 3) at the extreme forward end and with a generally straight sidewall 26 which expands outwardly to the arched upper radius 22 intersection with the cylindrical wall 14.

A first swirl injection level 28 and a second injection level 30 are provided at predetermined locations along the length of the container 12. The first swirl injection level 28 is located nearest the bottom 16 with the second swirl injection level 30 spaced forward towards the exhaust 18. The swirl injection levels 28 and 30 are generally indicated by the first and second feed manifolds 42 and 44, respectively.

Figure 4:
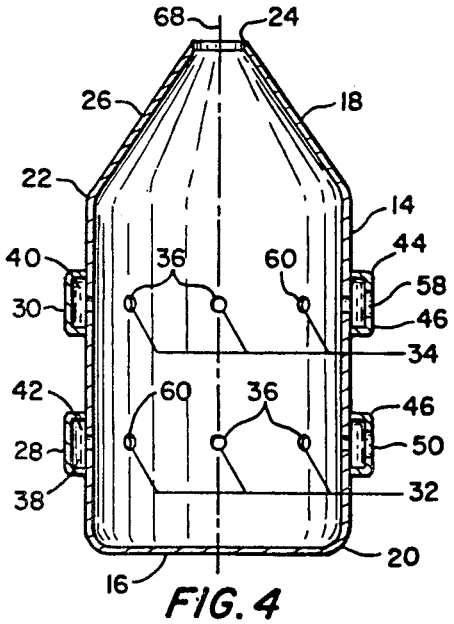
FIG. 4 is a vertical cross-sectional along lines 4—4 of FIG. 2.

As shown in FIG. 4, both swirl injection levels, 28 and 30 include, respectively, first and second injector sets, 32 and 34. Each injector set 32 and 34 contain a plurality of individual injectors 36 (see FIGS. 5 and 6). The injectors 36 of each injector set 32 and 34 communicate respectively with a first and second annular chamber 38 and 40.

By way of example, the first annual chamber 38 of the first feed manifold 42 communicates with the injectors 36 of the first injector set 32 for the first swirl injection level 28. The first feed manifold 42 is generally a "U" shaped channel 46 which circumvents the chamber 12 with the open side of the channel 46 directed inwardly. The second feed manifold 44 is structurally analagous to the first manifold 42.

Referring back to FIG. 1, a first fluid is transported to the first feed manifold 42 from first conventional storage means 48A through a connector 50 and conventional piping 52A and pressure control valve 54A. Similarly, the second fluid is transported to the second feed manifold 44 from second conventional storage means 48B through connector 58 and conventional piping 52B and pressure control valve 54B.

An alternate embodiment of the connectors 50 and 58 may include a plurality of separate connectors to each feed manifold. This alternate configuration would promote more uniform pressurization within the annular chamber. Numerous other alternatives to the feed manifold are also readily definable such as separate and individual connections to each of the respective injectors. All such alternatives are within the concept of this invention.

Figure 2:
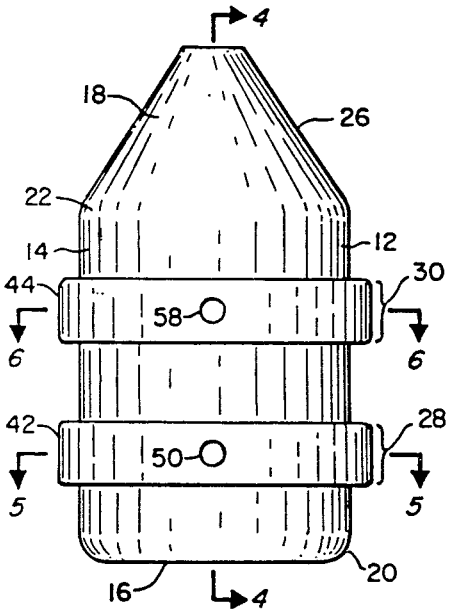
FIG. 2 is a front elevational view of the swirl mixing device of FIG. 1.

Referring to FIG. 2, the swirl mixing device 10 is shown in side elevation and it may be seen that the cylindrical wall 14 of the chamber 12 is generally straight and extends from the connection with the bottom 16 at the arched lower radius 20 to the connection with the exhaust 18 at the arched upper radius 22.

The first and second feed manifolds 42 and 44, respectively, are shown evenly spaced along the length of the container 12. This spacing is predetermined and adjusted depending upon the desired mixing time of the respective fluids or reagents. If less mixing time is necessary, the second injection level 30 may be moved forward towards the exhaust 18.

Figure 3:
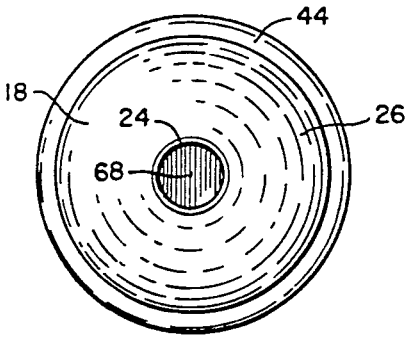
FIG. 3 is a top plan view of the swirl mixing device of FIG. 1.

FIG. 3 shows the top plan view of the swirl mixing device 10. The exhaust 18 includes a circular opening 24 in the extreme forward end of the conically shaped exhaust 18. The circular opening 24 is coaxially located about and coincident with the axial axis 68 (see FIG. 4) of the chamber 12 and the exhaust 18. The radius of the circular opening 24 is predetermined by adjusting the slope of the side wall 26 of the exhaust 18 and the altitude on the exhaust at which the circular opening 24 is made.

FIG. 4 shows a vertical cross-section of the swirl mixing device 10 taken generally at 4—4 of FIG. 2. The individual outputs 60 of the injectors 36 of the first and second injection levels, 28 and 30 are shown. The injectors 36 of each injector set 32 and 34 are shown in respective planes.

The U-shaped channels 46 of the first and second feed manifolds 42 and 44 are shown in cross section. The manifolds 42 and 44 may be attached to the chamber 12 in any suitable manner, such as welding. The first and second annular chambers 38 and 40 are shown in simple direct open communication with the injectors 36 or the first and second swirl injection levels, 28 and 30, respectively.

Figure 5:
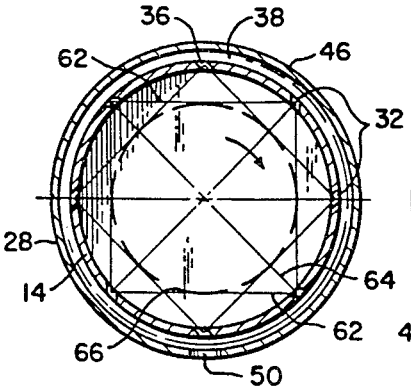
FIG. 5 is a horizontal cross-sectional along lines 5—5 of FIG. 2.
Figure 6:
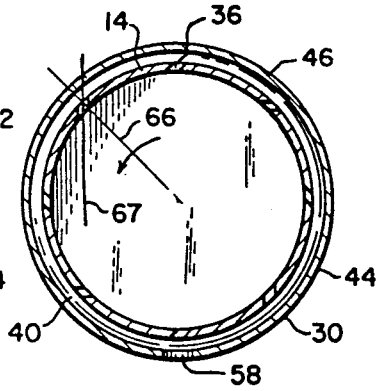
FIG. 6 is a horizontal cross-sectional along lines 6—6 of FIG. 2.

Referring to FIGS. 5 and 6, there is shown in horizontal cross-section, taken at 5—5 and 6—6 of FIG. 2, respectively, the first and second injector sets, 32 and 34 respectively. The first injector set 32 of the first swirl injection level 28, depicted in FIG. 5, shows the injectors 36 in simple communication with the first annular chamber 38. The feed manifold 42 and the cylindrical wall 14 provide the annular chamber 38 through which the first fluid is distributed to all injectors 36 of the first injector set 32.

Each injector 36 has a defined injector axis 62. In the embodiment shown, each injector 36 of each injector set 32 and 34, respectively, has common axial features. Each of the injector axes 62 for each injector set 36 has substantially the same radial, azimuthal and axial components. In the embodiment shown in FIG. 5, the axial component (sometime referred to as longitudinal) is zero and thus the injector axis 62 lies in the same plane as the injectors 36 themselves. The injector axis 62 for each of the injectors 36 of the first injector set 32 are shown at minus 45 degrees (−45°), or 45 degrees in the counterclockwise direction from a chamber radius 64 taken through of the respective injector 36. This configuration gives each injector 36 equal radial and azimuthal components.

Because each of the eight injectors 36 in the first injector set 32 have the common axial features, they are referred to as having a given tangent circle 66, as each of the injectors axes 62 tangentially intersects a common circle, tangent circle 66, of a predetermined radius. Adjusting the radial or azimuthal components of the injector axis 62 will result in a tangent circle of a different radius.

A tangent circle is a shorthand notation for the concept of the present invention that all injectors of a given injector set have common radial, azimuthal and axial components. Specifically, for the purposes of this device, the tangent circle of any injector set must have a radius less than the distance from the chamber axis to the injector opening. Preferably, the tangent circle of the method of the present invention indicates a radial velocity component which has a magnitude at least one-tenth (1/10) the magnitude of the azimuthal component.

Injection of the first fluid through the first injector set 32 results in a positive swirl or a circulation of fluid within the chamber 12 in a clockwise direction. This positive first fluid swirl produces an effective positive angular momentum of the first fluid. The positive swirling first fluid fills the chamber until it intersects the injection of the second fluid (see below).

FIG. 6 shows the second swirl injector level 30 with the second annular chamber 40 communicating with the injectors 36 of the second injector set 34. The second swirl injection level 30 has a positive angle between the chamber radius 66 and the injector axis 62 (clockwise direction). The second fluid is thereby injected into the chamber with negative swirl (counterclockwise) and negative angular momentum.

Counterbalancing the first and second fluid swirl is achieved by preselecting the injector axes, injector cross-section, number of injectors, injector pressure drop and chamber radius. Counterbalancing swirl is achieved when the mixed fluids have a small net angular momentum when compared to the angular momentum of any individual injected fluid.

The characteristics of the separate injector sets can be adjusted to achieve small net angular momentum injection rate by choosing them such that the net angular momentum injection rate is small relative to the angular momentum injection rate of any given level.

When the exhaust opening is centered near the container center line, the exhaust will be thoroughly mixed with little swirl energy remaining; thus, the injected swirl energy is not wasted in mixing with the environment outside the container and the mixing method will be energetically efficient.

It is important to note that FIGS. 4 and 5 show simple open orifice injectors 36. Many variations of the structure of the injector could easily be developed within the scale of the art.

Figure 7:
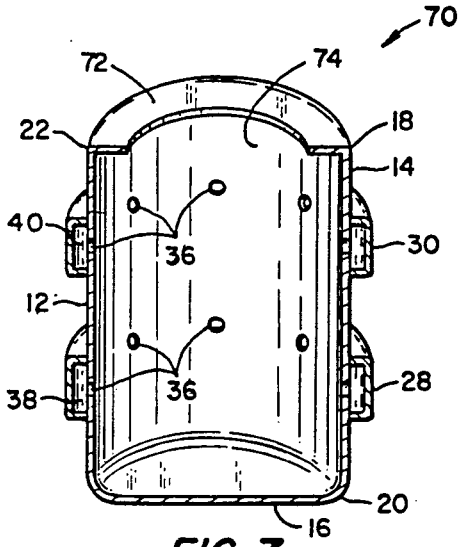
FIG. 7 is a perspective vertical sectional view of a swirl mixing device for use in a modification of the mixing method according to the invention.

FIG. 7 shows a vertical cross section of a second type of swirl mixing chamber in accordance with the method of the present invention for producing an exhaust mixture with modified characteristics. In this configuration, the structural features of the container 12 and the swirl injection levels 28 and 30 are analagous to the device 10 of FIG. 1. However, the exhaust 18 includes a substantially flat forward end 72. The flat forward end exhaust 72 intersects the cylinder wall 14 of the container 12 in an accute upper radius 22.

The flat forward end 72 of the second embodiment 70 includes a wide circular opening 74. Comparing the opening 24 of the device shown in FIG. 3 and the wide circular opening 74 of FIG. 7 shows that the relative size of the exhaust opening may vary considerably within the concept of the present invention.

It is important to note that an opening having a radius smaller than the radius of the smallest tangent circle for any of the given injector sets tends to prevent ejection of material having a residual angular momentum. In the embodiment having the wider circular opening 74, the ejected material located towards the outside of the exhaust cone will be less thoroughly mixed and will have higher angular momentum and tend to spin out and radially disperse. Material with residual angular momentum would attain large angular velocity (swirl) if it were forced toward the mixing chamber axis. This is analogous to the figure skater effect. The associated large centrifugal acceleration must be overcome by the pressure gradient force in order to drive swirling material toward the axis. Thus, material with relatively low angular momentum is selectively forced toward the mixing chamber axis.

While wide variation of exhaust port openings are within the concept of this invention, including, for example, wide circular openings, slit openings and cross openings, the preferred structure is a circular opening having a radius at least smaller than the radius of the smallest tangent circle of all injector sets.

Figure 8:
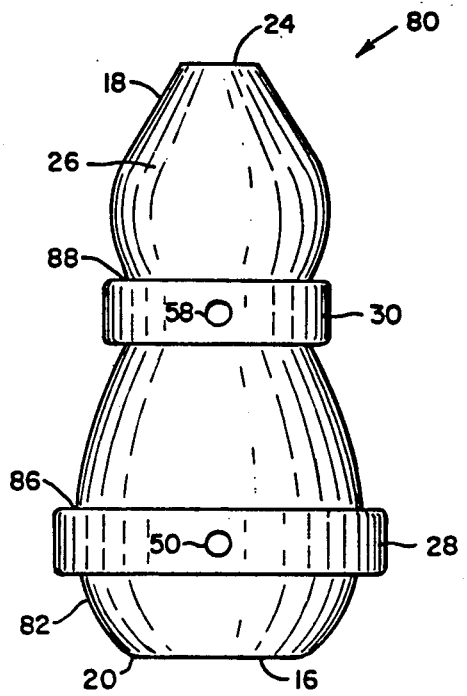
FIG. 8 is a side elevational view of a swirl mixing device providing a further modification of the mixing method.

Referring to FIG. 8, there is shown, generally at 80, a third embodiment of a swirl mixing device having a generally contoured container shape for a further modification of the mixing method. In the contoured swirl mixing device 80, the structure of the swirl injection levels 28 and 30 and the exhaust 18 are analagous to the corresponding structures of the device 10 shown in FIG. 4.

The contoured device 80 has generally an hourglass configuration. The configuration of the chamber can be structured with a variety of contours to exploit characteristics of a swirling flow. The contoured device, 80, includes a generally rounded lower portion 82 which intersects the flat bottom 16 in a smooth arched radius 20.

The center portion of the contoured device 80 has generally a necked down portion 88 giving the cylinder its hourglass shape. This contoured device 80 has its widest point 86 coincident with the first swirl injector level 28 and has its narrowest portion 88 coincident with the second swirl injection level 30. The contour of the chamber walls are smooth and gradually arched. In the embodiment shown, the radius of the most narrow point of the contour is approximately 75% that of the radius at its widest point.

The injected first reagent in the contoured swirl mixing device 80 will pass upward through the chamber and because of the container contour, the reagent will spin up (figure skater effect) whereby the material passing the narrow point on the contour will have higher tangential velocity. At this narrow point 88, the second reagent is introduced through the second swirl injection level 30 with counterbalanced swirl.

As seen from the above, it is possible to conform the contour of the cylindrical walls and the positioning of the swirl injection levels to satisfy specific requirements and objectives of the mixing method and the respective reagents.

Figure 9:
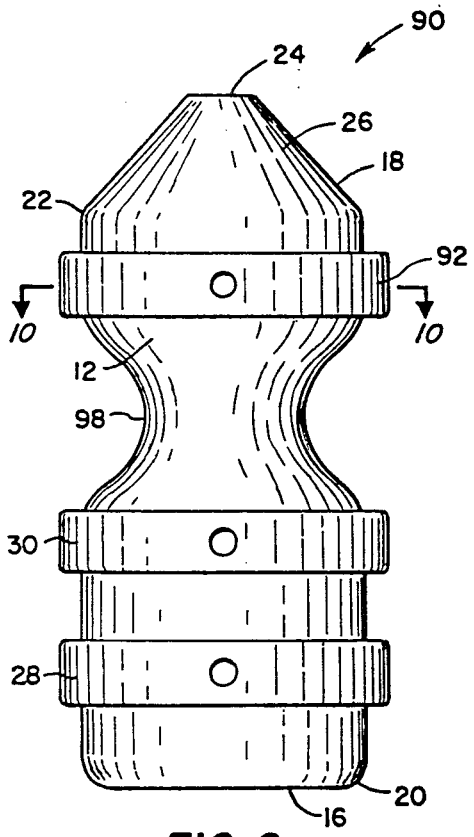
FIG. 9 is a side elevational view of another swirl mixing device providing a method of mixing three fluids according to the invention.

Referring to FIG. 9, a three level swirl mixing device is shown at 90. The structural features of the three level device 90 are analagous to the structural features of the swirl mixing device 10 shown in FIG. 1.

In the three level device 90, the spacing between the swirl injection levels is adjusted to reflect the desired mixing and/or reaction time requirements of the respective fluids. In the embodiment shown, the spacing between the first injector level 28 and the second injector level 30 is approximately $\frac{2}{3}$ that of the spacing between the second injector level 30 and the third injector level 92. Positioning of the injector levels along the container 12 is adjusted to correspond to the specific requirements of the fluids.

Between the second injection level 30 and the third injection level 92, the container includes a necked-down contour having its narrowest point located at 98, approximately midway between the second and third injection levels, 30 and 92 respectively. This necked-down portion 98 promotes thorough mixing of the first and second fluids prior to introduction of the third fluid at the thid injection level 92.

Figure 10:
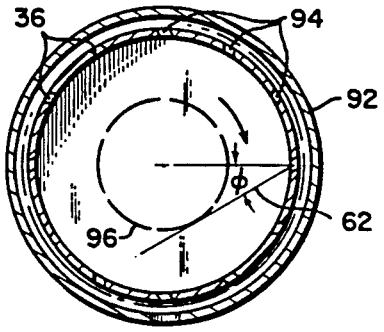
FIG. 10 is a horizontal cross-sectional view along lines 10—10 of FIG. 9.

Referring to FIG. 10, there is shown in horizontal cross section, the third injector set 94 of the third injector level 92 of the three level device 90. Each injector axis 62 has common axial, azimuthal and radial features for each of the injectors 36 within the third injection level 92. The third injector level 92 has twelve (12) injectors 36. The number of injectors 36 in an injector set can be easily varied to satisfy the specific requirements of the method.

As a general rule, the larger the number of injectors 36 around the circumference, the more consistent the pressure gradient of the fluid within the chamber 12. Further, the volume efficiency of the mixing chamber is increased by increasing the number of injectors and thereby reducing relatively dead areas between the injectors.

As shown in FIG. 10, the tangent circle 96 of the third injector level 92 is smaller than that of the first and second injector levels 28 and 30. In this embodiment, the angle $\phi$ between the third fluid injection level and the chamber radius is shown as approximately 30°, as opposed to 45° for the other levels. Clearly these angles will be chosen in accordance with the dimensions of the injectors, so that a relatively small net angular momentum is achieved, as discussed above in connection with FIGS. 1 to 6. Thus, in some applications, each fluid may be injected at a different angle to all the other fluids.

Figure 11:
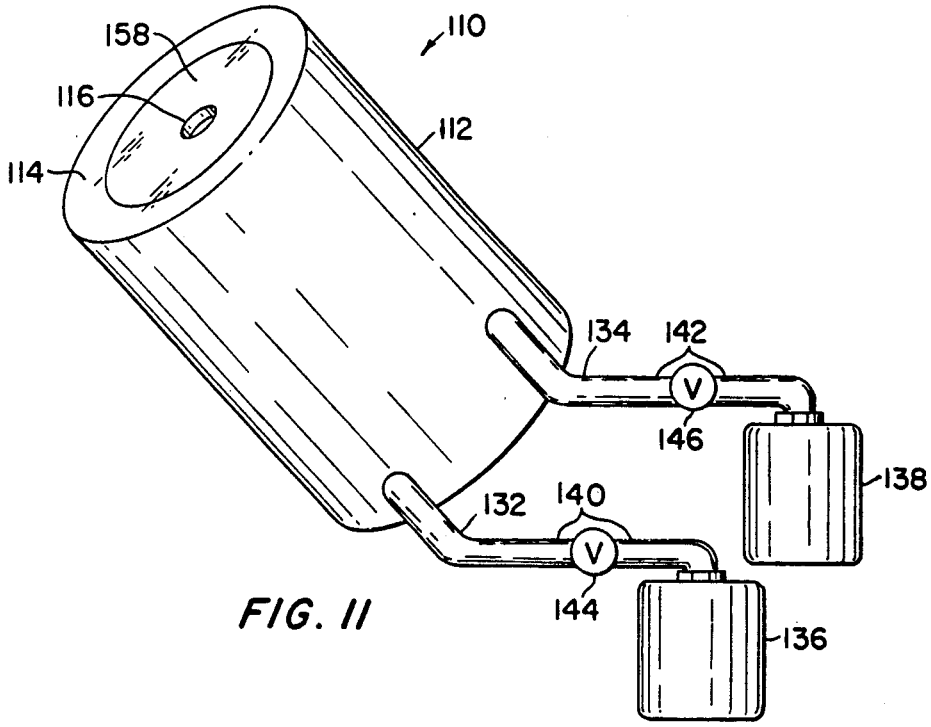
FIG. 11 is a perspective view of a modified swirl mixing device adopted to the mixing method of the present invention.
Figure 12:
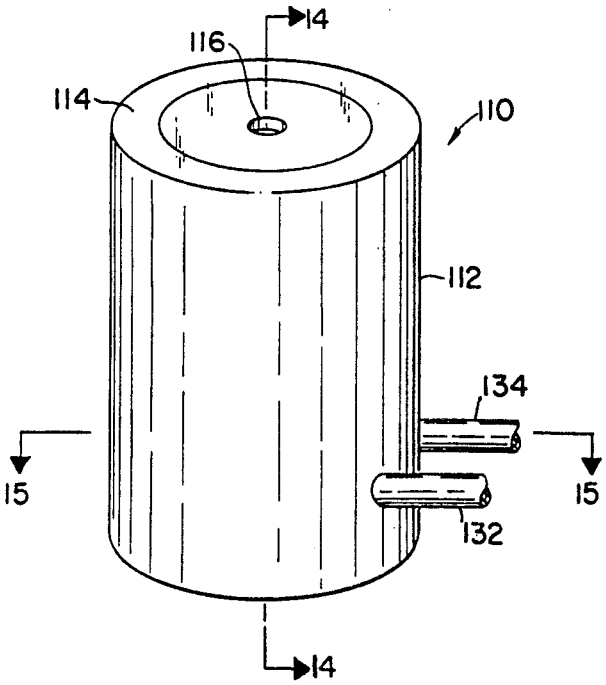
FIG. 12 is a front perspective view of the mixing device of FIG. 11.
Figure 13:
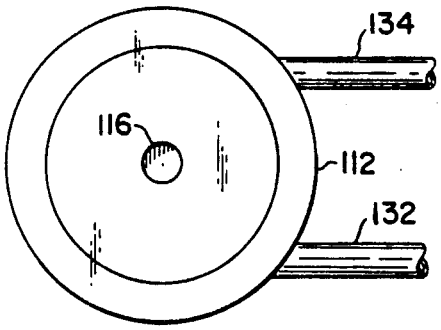
FIG. 13 is a top plan view of the mixing device of FIG. 11.

FIGS. 11 to 13 show a further embodiment of the method of mixing fluids according to the invention, in which the different fluids are introduced into different chambers separated by barriers. FIGS. 11 to 15 show a mixing device 110 comprising a cylindrically shaped container 112 closed at one end 114 with an exhaust opening 116 at the opposite end.

Fluids to be mixed together in the container 110 are stored in conventional storage means, as shown by way of example at 136 and 138. The storage means 136 and 138 are connected to the respective fluid injection pipes 132 and 134 via piping 140, 142 and pressure control valves 144 and 146.

Figure 14:
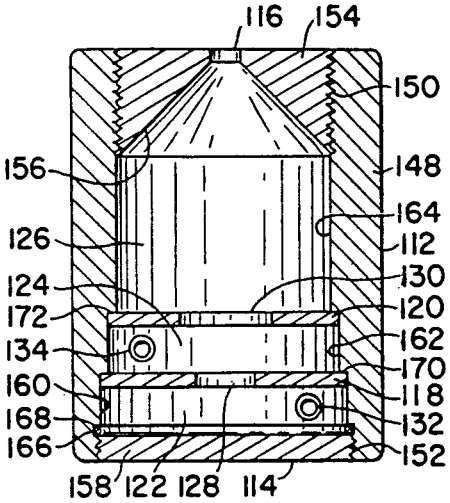
FIG. 14 is a vertical cross section along lines 4—4 of FIG 12.

As shown in FIG. 14 the interior of the container is divided by separating barriers 118 and 120 into a first fluid injection chamber 122, a second fluid injection chamber 124 and a final mixing chamber 126. Openings or passages 128 and 130 in barriers 118 and 120, respectively, connect the first chamber 122 to the second chamber 124, and the second chamber 124 to the mixing chamber 126, respectively.

A first fluid injection pipe 132 communicates with the first injection chamber 122, and a second fluid injection pipe 134 communicates with the second injection chamber 124. The first and second fluid injection pipes 132 and 134 may include swirl injection level structures as shown at 28 and 30 of swirl mixing device 10 of FIG. 1 described above.

The body of the container is seen to comprise an open-ended sleeve 148 with screw-threaded portions 150 and 152 on its inner surface at each end. The threaded portion 150 at the exhaust end of the container is in threaded engagement with an exhaust head 154 in which exhaust opening 116 is located. The head 154 has a conical internal surface 156 leading to opening 116.

The threaded portion 152 at the bottom end of the container is in threaded engagement with a base plate 158.

The interior of sleeve 148 has three portions 160, 162 and 164 of progressively stepped diameter defining the respective chambers 122, 124 and 126. An O-ring seal 166 is compressed between a first step 168 and a base plate 158 to prevent leakage from the bottom end of the container.

The collars 118 and 120 are removably mounted against steps 170 and 172, respectively.

This construction allows removal and replacement of the head 153, the base plate 158, and collars 118 and 120, for example to replace worn parts or to use parts of different shapes and sizes in order to modify the flow configurations within the chambers for different applications. Thus, for example, an exhaust head with a different internal shape or different size exhaust opening could be used, to change the characteristics of the exhaust mixture. Collars with different shapes or different size openings could be substituted, for example to accommodate fluids of different viscosities. The collars themselves need not be separate structures, but may be contoured portions of the inner surface of the sleeve.

Figure 15:
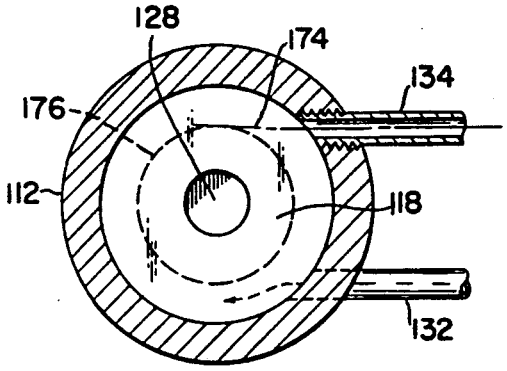
FIG. 15 is a horizontal cross section along lines 5—5 of FIG. 12.

FIG. 15 shows the entry direction of injection pipe 134 into injection chamber 124. Injection pipes 132 and 134 are oriented so as to direct the injected fluids in opposite directions of swirl in their respective chambers 122 and 124. The injection axis 174 of pipe 134 lies on a tangent to an imaginary circle in a plane perpendicular to the container axis. The circle is of diameter less than that of chamber 124 but greater than that of opening 130 in collar 120. Fluid injected into this region will tend to move in a counter-clockwise direction inwardly with a radial component due in part to the angle at which the fluid is injected into the chamber. Similarly, the injection axis of pipe 132 will be a tangent to a circle of diameter less than that of chamber 122 but greater than that of opening 128, and it will direct fluid entering the chamber in a clockwise direction. As pressure forces the fluid through opening 130, it will tend to exhibit a symetrical flow. This symetrical flow, through the respective barrier openings 130 and 128, represents an important feature of the method of this invention. The tangent circles may be of different diameters. Opening 130 is larger than opening 128, and exhaust opening 116 is smaller than the openings between the chambers (see FIG. 14).

The counter swirling fluids will meet in the region of opening 128 and thorough mixing will take place in chambers 124 and 126. The relatively large tangential velocities in opposite directions where the two fluids meet result in vigorous growth of small scale turbulent eddies. This is known as "centrifugal" or Taylor instability. It results in rapid mixing of the materials injected with opposing swirls, the reduced diameter opening where they meet enhancing the turbulent effect.

With this mixing method, relatively little pumping is required to achieve a given degree of mixing. When this method was used to produce a water spray, it was found to atomize 9 gallons per hour of water to a volume median diameter of 113 microns droplet size with only 2.5 psi air pressure at the rate of 1.7 standard cubic feet of air per minute. The device was found to have a stable performance over a wide range of air to water injection pressure ratios.

The structure of the mixing of this embodiment results in a high pressure region towards the outside of the chambers 124 and 126, caused by the fluid circulation. This high pressure causes a secondary flow of that fluid which has less swirl, i.e. angular momentum, towards the center of chambers 124 and 126. This effect is analagous to the "teacup effect" where tea leaves gravitate towards the center of the cup when the tea is stirred. Accordingly, that portion of the fluid which has low angular momentum and centrifugal acceleration is forced towards the center of chambers 124 and 126. Thus there is a selective movement of well-mixed (and hence low angular momentum) portions of the fluids towards the center of the chambers. Thus fluids entering chamber 126 through central opening 130 are relatively well mixed, and the same effect in mixing chamber 126 ensures even more thorough mixing prior to exhaust of fluids through opening 116.

This method substantially reduces or eliminates the centrifugal tendency of the fluids which are mixed and ejected from the container. Accordingly, the ejected mixture has relatively low dispersion characteristics and has a full cone exhaust pattern. "Full cone" exhaust means that the radial profile of the ejected mixture's axial velocity component has relatively high values near the center, as opposed to the low values occurring in rapidly swirling "hollow cone" exhaust patterns that occur when the angular momentum injection rates are not counterbalanced.

The injection pipe 132 may be choked, for example by means of a nozzle or, alternatively, a flow restricting washer at the opening of the injection pipe 132 and 134 (not shown) to allow adjustment of the relative velocities, mass flow rates and angular momentum injection rates of the fluids so as to achieve a small net angular momentum injection rate S (see equation for S above). The injection axis is also adjustable to adjust the angular momentum imparted to a fluid as it is injected into the chambers 124 and 126.

Figure 16:
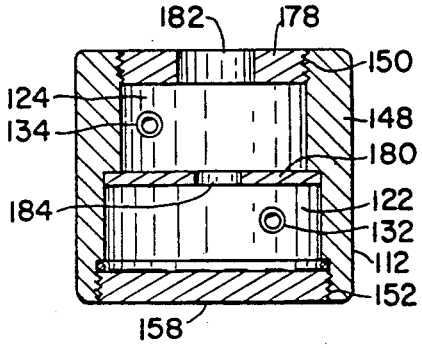
FIG. 16 is a vertical cross sectional view of a further modification of the mixing device adapted for use with a modified mixing method of the present invention.

FIG. 16 shows another modification of the swirl mixing method according to the invention. In this embodiment the cone shaped exhaust 154, the mixing chamber 126 and the upper portion 164 of the interior sleeve 148 have been removed leaving only a flat open exhaust head 178 and a single interior collar 180 to divide the container 112 into a first and second injection chamber 122 and 124. Thus the final mixing chamber is eliminated in this embodiment.

As in FIGS. 11 to 15, fluids are introduced into the respective chambers via injection pipes 132 and 134 which are arranged to direct the fluids with opposing swirls. Mixing occurs in the second injection chamber 124 prior to exhaust through circular exhaust opening 132 in flat exhaust head 178. Opening 182 is of larger radius than that of opening 184 in collar 180.

Other parts of this embodiment are analagous to parts in FIGS. 11 to 15 and have been given like reference numerals. Parts 158, 178 and 180 are removable and can be replaced by parts of different shapes and sizes, as in the first embodiment.

Figure 17:
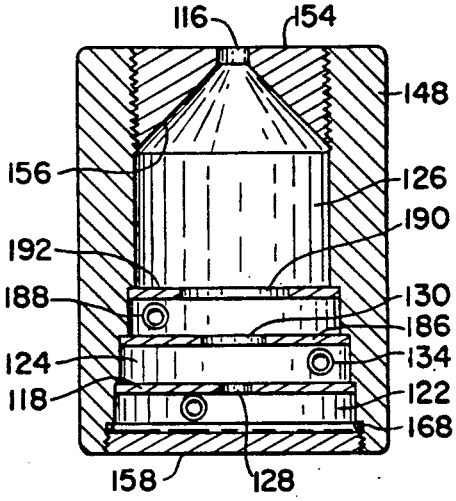
FIG. 17 is a vertical cross section through a mixing device for mixing three fluids.

FIG. 17 shows another modification of the mixing method in which a third fluid is injected to the mixing chamber. A third injection chamber 186 is provided between the first two injection chambers 122 and 124, and the final mixing chamber 126. A third fluid injection pipe 188 leads into chamber 186 from suitable fluid storage means (not shown). In the preferred embodiment, the injection pipes 132, 134 and 188 are of suitable relative orientations and/or sizes such that the fluid in each chamber tends to swirl in opposite direction to that of the fluid in the next adjacent chamber. The tangent circle of each injected fluid is chosen such that the net angular momentum is small, as described above in connection with FIG. 10. Thus the tangent circle may be of different diameter for each injected fluid. Within the scope of this invention adjacent injection pipes may inject fluids into adjacent chambers in the same direction provided that the net angular momentum of all injected fluids is small.

Preferably, however, the fluids entering chambers 132 and 134 swirl in opposite directions, and when the mixture of fluid leaves chamber 134 it will swirl in a direction determined by the relative magnitudes of the angular momentum of the first two injection fluids. The fluid entering chamber 186 via injection pipe 188 is arranged to swirl in the opposite direction to that of the mixed fluids in chamber 134.

The angular momentum injection rate of each fluid is therefore arranged such that the resulting angular momentum injection rate summed over all injected fluids is small compared to the angular momentum injection rate of a single injected fluid.

Clearly any number of fluids can be mixed together in this way, by the addition of extra injection chambers and suitably arranged injection pipes.

The construction in FIG. 17 is otherwise analagous to that of FIGS. 11 to 15, and like reference numerals have been used where appropriate.

The openings 128, 130 and 190 in collars 118, 120 and 192, respectively, which separate the chambers, are of progressively increasing radius towards the exhaust. The final mixing chamber may be eliminated as in the FIG. 16 embodiment so that the mixed fluids exhaust from the third injection chamber 186. The collars 118, 120 and 192 are removable as described in connection with FIGS. 11 to 15.

Figure 18:
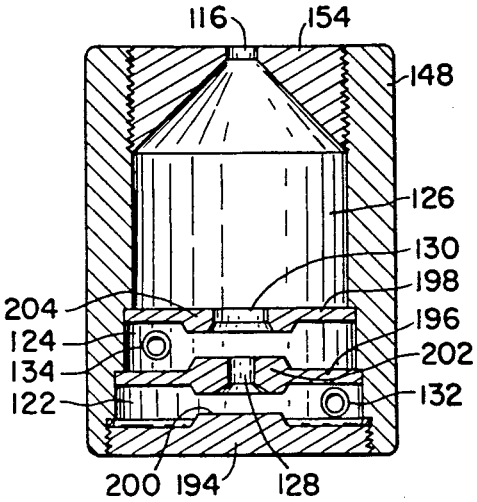
FIG. 18 is a vertical cross section through a further mixing device adapted for use in a further modification of the mixing method of the present invention.

In FIG. 18 the use of a shaped end plate 194 and shaped collars 196 and 198 to change the shapes of chambers 122 and 124 is shown. Other parts in this embodiment are analagous to parts in FIGS. 11 to 15 and have been given corresponding reference numerals.

End plate 104 has a central projection boss 200 and the two collars 196 and 198 are thickened at 202 and 204, respectively, adjacent their central openings. Thus each injection chamber has a depth which decreases towards the central line. This tends to produce nearly axisymmetric flow of the fluids near the shallowest point in their respective chambers, if the injection pipe openings are relatively large as compared to the minimum depth areas of the injection chambers. This allows efficient and substantially axisymmetric mixing even if relatively large amounts of fluids are used.

If significantly less of one fluid than the other is to be used, its injection chamber can be of uniform depth while the other injection chamber is of reduced depth near its opening. This can be achieved by replacing collar 198 by a flat collar and by replacing collar 196 with a collar having a flat upper face, for example.

Figure 19:
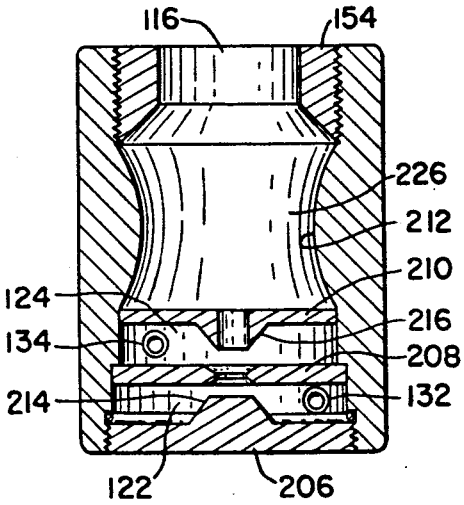
FIG. 19 is a vertical cross section through a further embodiment of a mixing device adapted for use in a further modification of the mixing method of the invention showing a contour of the chamber walls.

FIG. 19 shows another modification. A shaped end plate 206 and shaped collars 208 and 210 are again used, and a further modification is introduced in that the final mixing chamber 126 has an hourglass shaped inner contour having its narrowest point at 212. The hourglass contour is shown by way of example only as all surface contours are considered within the scope of this invention.

Because of the contoured mixing chamber shown in FIG. 19, the fluids will spin up at the narrowest point 212 (due to the so-called "figure skater effect") and this promotes more thorough mixing.

FIG. 19 also shows the exhaust opening 116 as wider than in previous embodiments. The exhaust opening is independent of other structural limitations shown in FIG. 19. Accordingly, all adjustments to the size of the exhaust opening are considered within the scope of the invention.

The shapes of plate 206 and collars 208 and 210 are such that opposed axial flow components are introduced to the fluid in chambers 122 and 124 as they are forced along conical surfaces 214 and 216, respectively. Accordingly, from the above, it can be seen that by structuring the contoured shapes of plate 206 and collars 208 and 210, a variety of axial components can be imparted to the fluid entering chambers 122 and 124. The adjustments of such contours are independent of other structural limitations of FIG. 19 and all variations thereof are considered within the scope of this invention.

Figure 20:
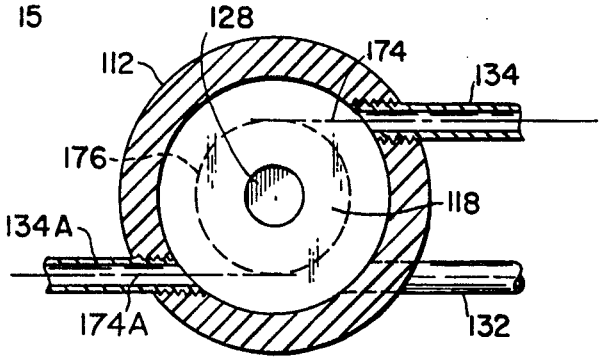
FIG. 20 is a horizontal cross section of a device for use in further embodiment of the method of the invention showing symmetrically spaced fluid injection positions.

FIG. 20 shows another modified method of fluid mixing wherein the injection chamber 124 includes opposed injection pipes 134 and 134A. The opposed injection pipes 134 and 134A are structured to inject fluids into injection chamber 124 with the same angular momentum thereby promoting symmetrical injection of the injected fluid. A plurality of symmetrically spaced injection orifices may be used for injecting fluid into each injection chamber in any of the embodiments shown in FIGS. 11 to 20, to promote more uniform flow and mixing characteristics.

The examples given above provide some indication of ways in which the mixing method can be varied to satisfy the requirements of various applications. These and other variations in the mixing method are within the scope of the invention.

Some examples of applications to which this mixing method can be adapted are: for low pressure mixing; for mixing of fluidized reagents in a reaction chamber; for a combustion chamber; for producing an atomized spray of fluid droplets, e.g. for paint spraying, water spraying, insecticide sprays, and the like; or for a chemical reaction chamber.

The mixing method of this invention is designed to promote smooth efficient mixing and/or atomization and the selective exhaust of only well mixed and/or atomized materials. The mixing occurs in areas well spaced from the chamber walls, thus allowing more freedom for the turbulent eddies to mix the fluids. This also reduces the tendency for abrasive or reactive fluids to damage the chamber walls.

Although the invention has been shown and described in connection with specific preferred embodiments, it will be understood that modifications can be made without departing from the scope of the invention. The invention is therefore not limited to the disclosed embodiments but is defined by the appended claims.

What is claimed is:

1. A method of mixing fluids, comprising the steps of:

symmetrically injecting a first fluid into a first area of a mixing chamber at a first tangent circle whose radius is smaller than the radius of the mixing chamber, said first fluid having a given angular momentum;

symmetrically injecting a second fluid into said mixing chamber into a second area of said mixing chamber at a second tangent circle whose radius is smaller than the radius of said mixing chamber, said second tangent circle within said second area being spaced from said first tangent circle within said first area, and said second fluid having an angular momentum opposite to that of said first fluid;

intersecting said first injected fluid having said given angular momentum with said second injected fluid having said opposite angular momentum;

counterbalancing the angular momentum of said first fluid against the opposite angular momentum of said second fluid such that the net angular momentum injection rate of all injected fluids is less than the angular momentum injection rate of any given injected fluid, allowing said mixed fluids to exhaust from said chamber through an exhaust part in a direction transverse to said tangent circles.

2. The method of claim 1, wherein said second fluid is injected at a tangent circle having a radius different from that of said first tangent circle, said different radii being adjusted so as to produce a total angular momentum injection rate which is smaller than the individual angular momentum injection rates of the fluids.

3. The method of claim 1, wherein said fluids are each injected from a plurality of spaced locations around said mixing chamber, said first fluid injection locations lying in a first plane perpendicular to said mixing chamber central axis and said second fluid injection locations lying in a second plane parallel to and spaced from said first plane.

4. The method of claim 1, wherein said exhaust part lies around said mixing chamber central axis and has a diameter smaller than that of the smallest tangent circle.

5. The method of claim 1, further including the steps of injecting one or more further fluids into said mixing chamber at areas spaced from said first and second fluid injection areas, said first, second, and further fluids each being injected with a preselected angular momentum and respective tangent circle, such that the total angular momentum injection rate, summed over all injected fluids, is less than the angular momentum rate of any given injected fluid.

6. The method of claim 5, wherein the diameter of the tangent circle of each injected fluid is different from the diameters of the tangent circles of the other injected fluids.

7. The method of claim 1, wherein said fluids are injected into a mixing chamber of contoured shape.

8. The method of claim 7, wherein said contoured shape comprises an hourglass configuration, and one of said fluids is injected at the narrowest point of said hourglass.

9. The method of claim 7, wherein said contoured shape is an hourglass configuration, and said fluids are injected on opposite sides of the narrowest part of said hourglass.

10. The method of claim 1, wherein the injection directions of said fluids each have a radial component of at least ten percent (10%) of the azimuthal component.

11. The method of claim 1 wherein said angular momentum injection rates are counterbalanced by adjusting, respectively, the injection rates of said first and second fluids and the first and second tangent circles of said first and second fluids.

12. A method of mixing fluids comprising the steps of:

injecting a first fluid into a first injection chamber with a given angular momentum and at a first predetermined tangent circle of radius less than that of said first injection chamber;

injecting a second fluid into a second injection chamber separated from said first injection chamber by a barrier, said second fluid being injected with an angular momentum opposite to that of said first fluid and at a second predetermined tangent circle of radius less than that of said second injection chamber;

allowing said first fluid to flow from said first injection chamber to said second injection chamber via passage means in said barrier, such that said fluids intersect;

counterbalancing the given angular momentum injection rate of said first fluid against the opposite angular momentum injection rate of said second fluid such that the total angular momentum injection rate summed over all injected fluids is less than the angular momentum injection rate of any given injected fluid, and allowing said mixed fluids to exhaust from said chamber through an exhaust part in a direction transverse to said tangent circles.

13. The method of claim 12, including the further step of exhausting said mixed fluids from said second injection chamber through an exhaust port lying on the central axis of said second injection chamber.

14. The method of claim 13, wherein said exhaust port is larger than said passage means.

15. The method of claim 12, wherein the radius of said first fluid tangent circle is different from the radius of said second fluid tangent circle.

16. The method of claim 12, including the step of mixing said fluids in a final mixing chamber separated by a further barrier from said second injection chamber, passage means being provided in said further barrier.

17. The method of claim 16, including the further step of exhausting said mixed fluids from said final mixing chamber through an exhaust opening lying on the central axis of said final mixing chamber.

18. The method of claim 17, wherein said exhaust opening is smaller than the smallest tangent circle of said injected fluids.

19. The method of claim 12, wherein one or more further fluids are injected into one or more further injection chambers, said first, second and further injection chambers being separated by barriers having passage means for fluid passage from one chamber to the next, and each fluid being injected with a preselected angular momentum and at a predetermined tangent circle such that the total angular momentum summed over all fluids is less than the injected angular momentum of any given fluid.

20. The method of claim 19, wherein the tangent circle diameter of each injected fluid is different from the tangent circle diameters of the other injected fluids.

21. The method of claim 19, in which said fluids are progressively mixed in said injection chambers and exhausted from a final one of said chambers, said passage means being of progressively increasing size towards said exhaust.

22. The method of claim 19, in which said fluids flow from a final one of said injection chambers into a mixing chamber having an exhaust opening.

23. The method of claim 12, wherein said fluid injection chambers are shaped so as to introduce an axial flow component to the fluids in said chambers.

24. The method of claim 12, wherein said fluids are injected by adjustable choking means for changing the direction, velocity and mass flow of the injected fluids.

25. The method of claim 12 wherein said angular momentum injection rates are counterbalanced by adjusting, respectively, the injection rates of said first and second fluids and the first and second tangent circles of said first and second fluids.

26. A method for mixing a plurality of injected fluids comprising the steps of:

injecting the first injected fluid into one level of a container at a first injection rate said injection being symmetrically directed at a first tangent circle such that said first injected fluid has a first angular momentum injection rate with respect to an axis of said container;

injecting a second injection fluid into a second level of said container at a second injection rate said injection being symmetrically directed at a second tangent circle such that said second injected fluid has a second angular momentum with respect to said container axis which is generally opposite to said first injected fluid; and intersecting said first injected fluid with said second injected fluid such that the sum of the angular momentum injection rates of said first injected fluid and said injected fluid is less than the angular momentum injection rate of either the first injected fluid or the second injected fluid, allowing said mixed fluids to exhaust from said chamber in a direction transverse to said tangent circles.

* * * * *